US008634278B1

(12) United States Patent
Nguyen

(10) Patent No.: US 8,634,278 B1
(45) Date of Patent: Jan. 21, 2014

(54) TALKING WATCH DEVICE

(76) Inventor: Trinh A. H. Nguyen, Westminster, CA (US)

( * ) Notice: Subject to any disclaimer, the term of this patent is extended or adjusted under 35 U.S.C. 154(b) by 921 days.

(21) Appl. No.: 12/700,675

(22) Filed: Feb. 4, 2010

(51) Int. Cl.
*G04C 21/14* (2006.01)

(52) U.S. Cl.
USPC ..... 368/63; 434/304

(58) Field of Classification Search
USPC ..... 368/63
See application file for complete search history.

(56) References Cited

U.S. PATENT DOCUMENTS

| | | | | | |
|---|---|---|---|---|---|
| 242,774 | A | | 6/1881 | Healey | |
| 3,998,045 | A | | 12/1976 | Lester | |
| 4,287,584 | A | * | 9/1981 | Tanimoto et al. | 368/63 |
| 4,307,459 | A | | 12/1981 | Iwao | |
| 4,397,562 | A | * | 8/1983 | Shirasu | 368/63 |
| 4,421,416 | A | | 12/1983 | Hashimoto et al. | |
| 4,500,211 | A | | 2/1985 | Hashimoto et al. | |
| 4,531,841 | A | * | 7/1985 | Puff | 368/63 |
| 4,545,686 | A | * | 10/1985 | Ushikoshi | 368/63 |
| 4,573,134 | A | * | 2/1986 | Ikemoto | 708/112 |
| 4,701,862 | A | * | 10/1987 | Washizuka et al. | 704/274 |
| 4,706,288 | A | * | 11/1987 | Hashimoto et al. | 704/270 |
| 4,799,890 | A | * | 1/1989 | Thompson et al. | 434/304 |
| 4,879,699 | A | * | 11/1989 | Sakamoto | 368/63 |
| 5,309,413 | A | * | 5/1994 | Chan | 368/63 |
| 6,307,813 | B1 | | 10/2001 | Leggio | |
| 6,406,301 | B2 | * | 6/2002 | Richards | 434/304 |
| 6,665,233 | B2 | * | 12/2003 | Cosgrove | 368/10 |
| 6,962,494 | B1 | * | 11/2005 | Olson | 434/304 |
| 7,376,051 | B2 | * | 5/2008 | Rosen | 368/63 |
| 7,463,556 | B2 | * | 12/2008 | Hocherman | 368/74 |
| 7,843,769 | B2 | * | 11/2010 | Ishida et al. | 368/82 |

* cited by examiner

*Primary Examiner* — Amy Cohen Johnson
*Assistant Examiner* — Jason Collins

(57) ABSTRACT

A talking watch device for helping a user learn time comprising a base having a clock face; a quartz oscillator assembly; a digital counter operatively connected to the quartz oscillator assembly and to a microprocessor, the digital counter keeps track of a time, day, month, and year component; a memory medium for storing a plurality of audio messages; a speaker component operatively connected to a digital to analog converter; and a dial operatively connected to the microprocessor, the dial can move between a first position, a second position, a third position, and a fourth position, wherein the microprocessor is configured to receive input signals from the dial whereupon the microprocessor generates output commands to the speaker to play a time component message and/or a day component message and/or a month component message and/or a year component message.

19 Claims, 4 Drawing Sheets

TALKING WATCH DEVICE

FIELD OF THE INVENTION

The present invention is directed to a watch, more particularly to a watch comprising a speaker for audibly telling the time.

BACKGROUND OF THE INVENTION

Many children have a difficult time learning how time fits into our calendar and to tell time by viewing twelve-hour analog watches (the twelve hour representation of time seen on most clock faces and watches). The present invention features a talking watch device for providing an audio readout of the time. The device can help children (e.g., children ages 2 to 7) learn how to understand and visualize time. The device can also help children learn how to start counting from one to twelve and to recognize the alphabet.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a talking watch device for helping a user learn time, said watch device comprising a base having a display for displaying a clock face; a quartz oscillator assembly disposed in the base, a digital counter operatively connected to the quartz oscillator assembly and to a microprocessor, the digital counter keeps track of a time component and a day component and a month component and a year component; a memory medium for storing a plurality of pre-recorded audio messages, the pre-recorded audio messages include a plurality of time component messages, a plurality of day component messages, a plurality of month component messages, and a plurality of year component messages; a speaker component disposed in the base, the speaker is operatively connected to a digital to analog converter for converting the pre-recorded audio message into an analog signal for the speaker; and a dial operatively connected to the microprocessor, the dial can move between a first position, a second position, a third position, and a fourth position, wherein the microprocessor is configured to receive a first input signal from the dial when the dial is in the first position whereupon the microprocessor generates a first recall command to the digital counter to obtain the time component whereupon the microprocessor generates a first output command to the speaker to play a time component message at a certain frequency, the time component message is based on the time component obtained from the digital counter; wherein the microprocessor is configured to receive a second input signal from the dial when the dial is in the second position whereupon the microprocessor generates a second recall command to the digital counter to obtain the time component and the day component whereupon the microprocessor generates a second output command to the speaker to play a time component message and a day component message at a certain frequency, the time component message and the day component message is based on the time component and the day component obtained from the digital counter; wherein the microprocessor is configured to receive a third input signal from the dial when the dial is in the third position whereupon the microprocessor generates a third recall command to the digital counter to obtain the time component and the day component and the month component whereupon the microprocessor generates a third output command to the speaker to play a time component message and a day component message and a month component message at a certain frequency, the time component message and the day component message and the month component message is based on the time component and the day component and the month component obtained from the digital counter; and wherein the microprocessor is configured to receive a fourth input signal from the dial when the dial is in the fourth position whereupon the microprocessor generates a fourth recall command to the digital counter to obtain the time component and the day component and the month component and the year component whereupon the microprocessor generates a third output command to the speaker to play a time component message and a day component message and a month component message and a year component message at a certain frequency, the time component message and the day component message and the month component message and the year component message is based on the time component and the day component and the month component and the year component obtained from the digital counter.

In some embodiments, the watch device further comprises a strap for attaching the base to a wrist of the user. In some embodiments, the clock face is a digital version of a mechanical clock face. In some embodiments, the digital version of the mechanical clock face is a liquid crystal display (LCD). In some embodiments, the digital version of the mechanical clock face is a thin film transistor (TFT) LCD. In some embodiments, the clock face is a mechanical clock face. In some embodiments, the clock face is operatively connected to the digital counter or to the microprocessor.

In some embodiments, the digital counter is operatively connected to a power source. In some embodiments, the power source is a battery. In some embodiments, the microprocessor is a digital logic control circuit. In some embodiments, the time component is an hour and minute. In some embodiments, the time component is an hour. In some embodiments, the certain frequency is once or more every hour. In some embodiments, the memory medium is read-only memory or flash memory. In some embodiments, the speaker is disposed in a side edge of the base. In some embodiments, the talking watch device further comprises a power button for turning the watch device on and off. In some embodiments, the user can adjust the certain frequency. In some embodiments, the watch device further comprises a setting means for setting the time component the day component and the month component and the year component.

In some embodiments, the watch device can be plugged into a computer to synchronize with a downloadable program that shows the watch device's time and voice components in a kids friendly/appealing calendar format (as to further aid a child to encompass what it is that they have been seeing and hearing from the watch device). In some embodiments, the watch device can be plugged into a computer to be loaded with recorded messages from the parent. All these embodiments will function in coexistence with a website, designed specifically for the "Kids Talking Watch" in order to download many varieties of applications that can be input into a downloadable calendar, which then could be transferred into the watch device. For example, each watch device would be given a serial number (depending on the year it was sold) in order to recognize which calendar to download from the website, Once the calendar is open, one can click on a specific date and then input/remove any application for costume message into/out of that specific date. Once this has been done, one can now install this program into the watch device. In some embodiments, the website would have software able to convert type messages into data that ultimately will transmit voices, to be input into a specific date, which then will ultimately be transfer into the watch device. This calendar is like a control center, where the parents can adjust, rearrange, add, and/or delete many applications, for example, when and what should be announced at any or a specific time, etc. These applications would be appropriate to help remind grown ups and the child; (in case of forgetting) to be patient with the child, and many more applications that can also add educational value and fun. For example, when it is almost time for a child to go to bed and the parents should want to remind the young child to go relieve themselves (in-case of forgetting) so that the child will not wet the bed, the parents would be able to do so; for example, when they should turn off the TV and go outside to play; for example, when they are spending the night at their friends house to be able to remind them good night in case of forgetting to call. For example, when they are at their nanny's house and it is almost that time to go home, that they should have their stuff ready because the parents are coming to pick them up, alternatively, when it is their time to do their homework. Alternatively, simply at their lunch hour the parents just wanted to tell their kids that their mom and dad love them or any other words of encouragement etc. It can also record the happy birthday song and be able to input it into the certain settings of the watch, to be announced at a certain set time. For example, each holiday can be added with a specific song. For example, on Christmas Eve, the Christmas carol can be played. It will become apparent in the future, in real-world applications that many more scenario can be applied. For example, it would be an embodiment for parents to monitor and give their child what they want appropriately programmed into the device.

The present invention also features a method of teaching time, the method comprising obtaining said watch device and setting the dial in the first position, the second position, the third position, or the fourth position.

DESCRIPTION OF PREFERRED EMBODIMENTS

Figure 1:
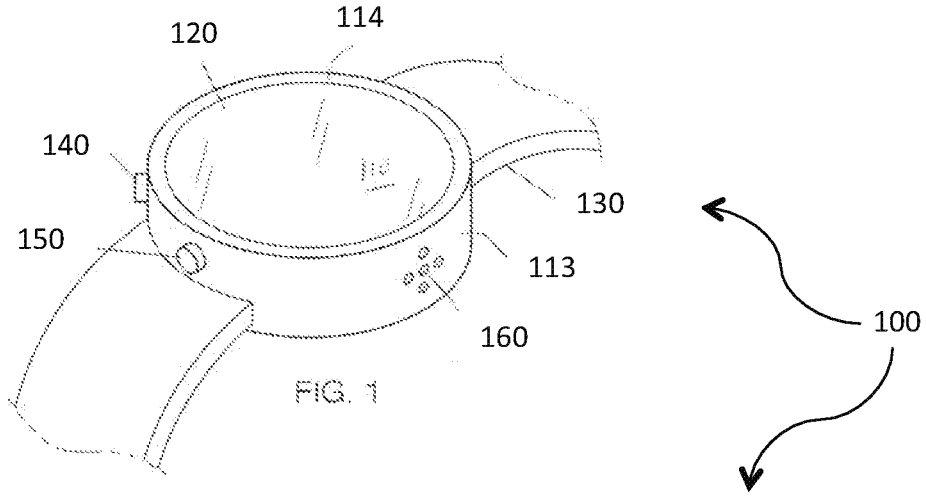
FIG. 1 is a perspective view of the talking watch device of the present invention.
Figure 2:
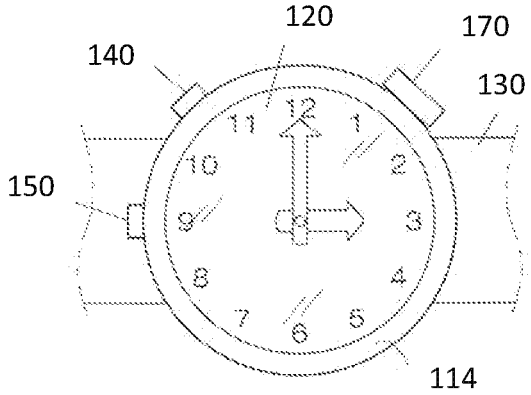
FIG. 2 is a front view of the talking watch device of the present invention.
Figure 3:
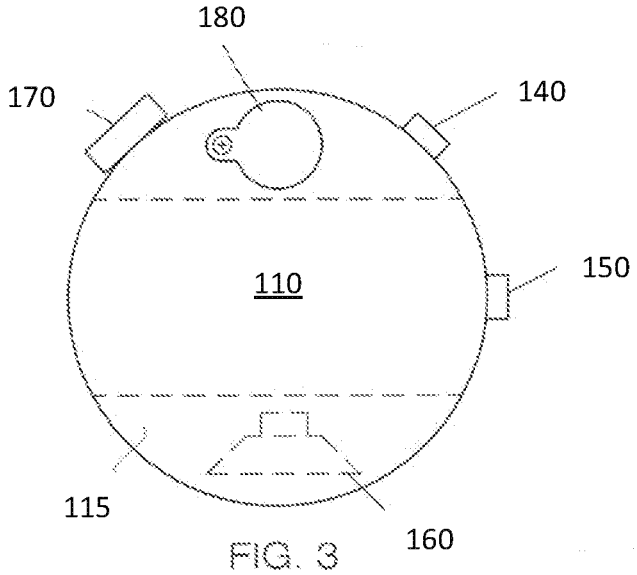
FIG. 3 is a back view of the talking watch device of the present invention.
Figure 4:
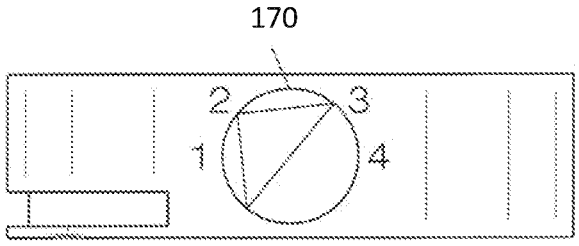
FIG. 4 is a side view of the talking watch device of the present invention.
Figure 5:
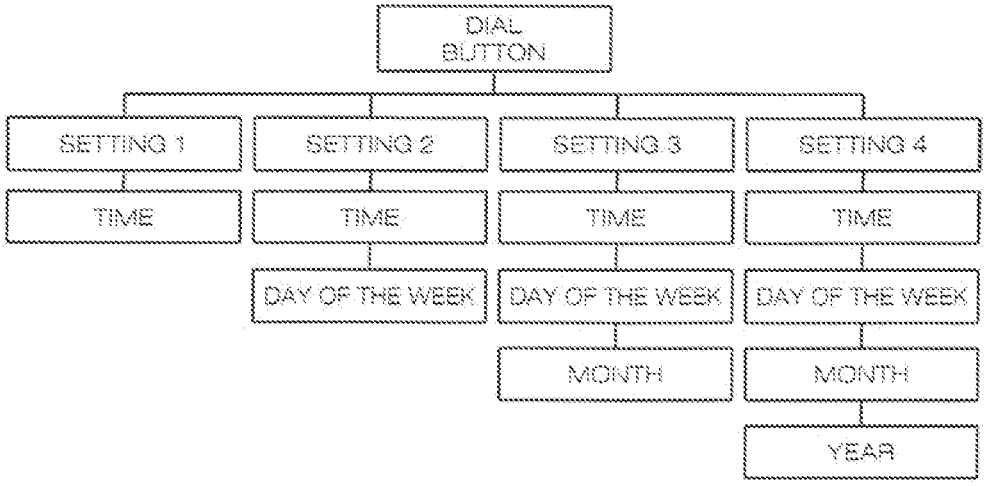
FIG. 5 is a schematic representation of the dial of the talking watch device of the present invention.
Figure 6:
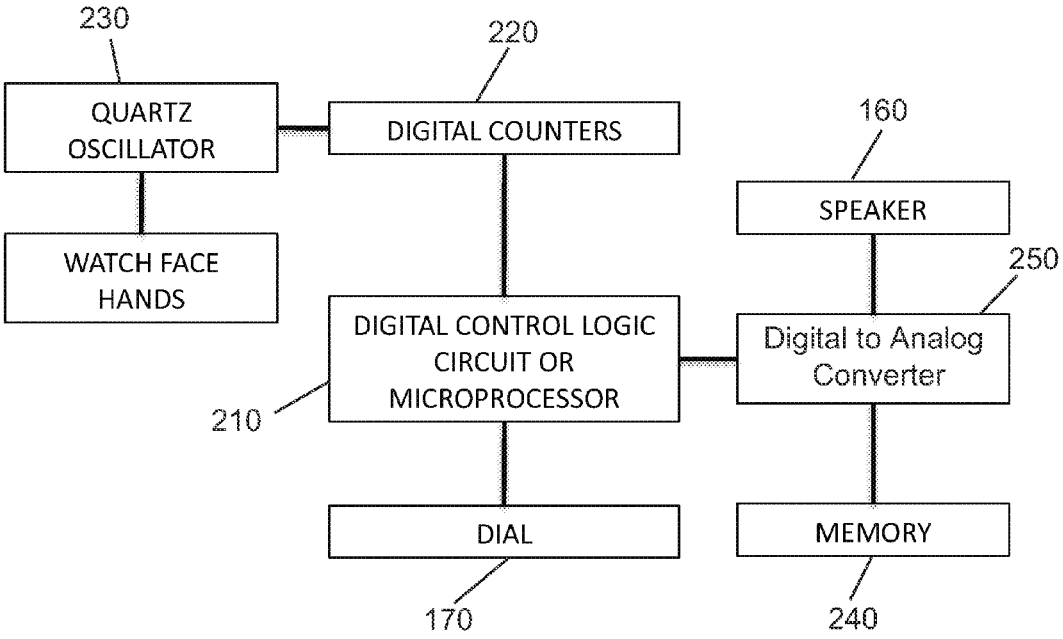
FIG. 6 is as schematic representation of the electrical components of the talking watch device of the present invention.

Referring now to FIG. 1-6, the present invention features a talking watch device 100. The talking watch device 100 may be used to help children (e.g., children ages 2 to 7) learn how to understand and visualize time (and/or a calendar). The watch device 100 provides an audio readout of the time indicated on the watch. The watch device 100 not only provides educational value but fun as well. For example, in some embodiments, the audio readout of the time may be spoken in a voice of a cartoon character or in a voice appealing to the child. The watch device 100 may be constructed in various sizes, shapes, colors, and designs.

The present invention also features a method of teaching time using the watch device of the present invention. In some embodiments, various components of time are taught in stages, for example for stages (e.g., hour, day, month, and year). For example, a first stage (hour) may be taught, and as the child learns other stages (day, month, year) may be gradually added. In some embodiments, the watch device 100 allows for visualizing letters (e.g., alphabet), and a child can be taught the letters with the device 100. In some embodiments, the letters can be arranged in a fixed order (e.g., via a parent's manipulation of the device 100). In some embodiments, the device 100 can be configured to play an audio clip related to the letters, for example stating the name of the letters.

The talking watch device 100 resembles standard watches in appearance and function. Standard watches are well known to one of ordinary skill in the art. For example, the talking watch device 100 comprises a base 110 and a strap 130 for attaching the base 110 to a user's wrist. The base 110 has a side edge 113, a top surface 114, a bottom surface 115, and a display 120 atop the top surface 114. The display 120 displays the clock face.

In some embodiments, the watch device 100 of the present invention is an analog watch with the display 120 comprising a mechanical hour hand and minute hand. In some embodiments, the watch further comprises a seconds hand. In some embodiments, the watch device 100 of the present invention is digital but displays a digital version of the mechanical clock face, for example the clock face appears to be analog. Like standard watches, the watch device 100 of the present invention comprises a setting means for setting the appropriate time (and/or day of week and/or month and/or year), which is well known to one of ordinary skill in the art. For example the watch 100 comprises a time setting button 140 that can be wound forwardly and backwardly to move the hands to the appropriate position. In some embodiments, the watch 100 comprises one or more time setting buttons for digitally setting the time/day/month/year.

The talking watch device 100 can announce the time and/or day of the week and/or month and/or year. For example, the watch device 100 comprises a dial 170 that can move between a first position for a first setting, a second position for a second setting, a third position for a third setting, and a fourth position for a first fourth setting.

When the dial 170 of the watch device 100 is in the first position (e.g., set on the first setting), the watch announces the time of day. For example, if the display 120 shows the hands are at 1:00, the watch device 100 would announce "one o'clock." In some embodiments, when the dial 170 is on the first setting (e.g., level 1), the watch announces the hour, and the announcement occurs on every hour.

When the dial 170 of the watch device 100 is in the second position (e.g., set on the second setting), the watch announces the time of day and the day of the week. For example, if the watch face was set at 2:00 on Tuesday, the watch would announce "two o'clock Tuesday." In some embodiments, when the dial 170 is on the second setting (e.g., level 2), the watch announces the hour and the day of the week, and the announcement occurs on every hour.

When the dial 170 of the watch device 100 is in the third position (e.g., set on the third setting), the watch announces the time of day, the day of the week, and the month. For example, if the watch face was set at 1:00 on Tuesday in March, the watch would announce "one o'clock Tuesday March Twenty-four" In some embodiments, when the dial 170 is on the third setting (e.g., level 3), the watch announces the hour, the day of the week, and the month, and the announcement occurs on every hour.

When the dial 170 of the watch device 100 is in the fourth setting (e.g., set on the fourth setting), the watch announces the time of day, the day of the week, the month, and the year. For example, if the watch face was set at 2:00 on Thursday in April 2012, the watch would announce "two o'clock Thursday April 2012". In some embodiments, when the dial 170 is on the fourth setting (e.g., level 4), the watch announces the hour, the day of the week, the month, and the year, (with brief pauses in-between) and the announcement occurs on every hour.

The watch device 100 of the present invention comprises a speaker component 160 (e.g., built into the base 110) for announcing the time of day and/or day of week and/or month and/or year. Speaker components are well known to one of ordinary skill in the art. In some embodiments, the speaker 160 is disposed in the side edge 113 of the base 110, for example near the "6" on the face of the clock. The speaker component 160 is not limited to this position.

Generally, watches and clocks use quartz crystals as a timekeeping device. For example, when an electric current is passed through the quartz crystal it will oscillate at a very specific frequency. This frequency can then be divided electronically (or mechanically in the case of the device in U.S. Pat. No. 3,998,045) to produce oscillations of one hertz (one oscillation per second). In standard watches, the one hertz oscillation may be attached to a gear that controls the analog mechanical hands (e.g., the seconds hand) of the watch device 100 so as to advance the mechanical hands. Or, the one hertz oscillation may be attached to a digital counter, which keeps time in a digital format.

The quartz oscillator assembly 230 of the talking watch device 100 of the present invention is operatively connected to one or more digital counters to keep time (and the date and month and year) in a digital format. This allows the device 100 to be able to announce specific dates and/or times and/or months and/or years. For example, in some embodiments, the quartz oscillator assembly is operatively connected to a first digital counter for keeping time in a digital format, a second digital counter for keeping the day of the week, a third digital counter for keeping the month, and a fourth digital counter for keeping the year. Digital counters are well known to one of ordinary skill in the art.

However, the clock face of the display 120 may be either analog (e.g., mechanical hands moving) or a digital version of the analog clock face (e.g., a liquid crystal display that appears like an analog clock face with moving hands, a "screen"). If the clock face of the display 120 is analog, the gears that control the clock face are also operatively connected to the quartz oscillator assembly that generates an electric signal of 1 Hz.

The digital counters 220 are each operatively connected to either a digital logic control circuit or a microprocessor 210. Digital logic control circuits and microprocessors are well known to one of ordinary skill in the art. For example, a microprocessor is programmable so that it can execute a program. The microprocessor generates output commands by performing operations on the input signals as instructed by the program. The digital logic control circuit may generate output commands based only on the inputs, much like how a mathematical function produces the "output" dependent variable from the "input" independent variable.

In some embodiments, the dial 170 is also operatively connected to the digital logic control circuit or the microprocessor, and the dial 170 provides the digital logic control circuit or microprocessor with the input signal based on the position/setting of the dial 170. For example, the device 100 may comprise four wires, each wire connected to the digital logic control circuit and each connected to one of the settings for the dial 170. When the dial 170 is turned to a particular position/setting (e.g., the first position), the wire corresponding to the first position/setting is turned on, sending a signal to the digital logic control circuit or microprocessor. Upon receipt of the input signal, the digital logic control circuit or microprocessor sends an output command to the speaker to play a pre-recorded audio message (e.g., the time of day). The pre-recorded audio message may be determined by the digital counters, which calculate the time, day, month, and year. In some embodiments, the selection of the four settings/positions of the dial 170 may be encoded in binary format.

As an example of the use of the digital logic control circuit, when the watch face is on the hour (e.g., when the watch face reads 3:00), the digital counters indicate to the microprocessor or the digital logic control circuit that it is now on the hour and that the time should be announced by the speaker. In some embodiments, the hour digital counter would indicate a binary value of "0011" (decimal value 3 in 4-bit binary) to the control unit, and if the dial 170 is set to position three, then the third wire will be activated. Based on these conditions, the combinational logic will be designed to select the appropriate message stored in ROM memory to play on the speaker. Based on these conditions, the combinational logic can be designed to select the appropriate hour that the watch would announce the time. For example, all hours while the child would be asleep would be skipped.

The various pre-recorded audio messages that are to be played to announce the time, day of the week, month, and year twelve o'clock, one o'clock, five o'clock, six o'clock, eight o'clock, twelve thirty, one forty, two ten, three fifteen, four forty five, pm or am, Monday, Tuesday, Wednesday, Thursday, Friday, Saturday, Sunday, January twenty eight, February fourteen, March, April, May, June, July, August, September, October, November, December, 2010, 2011, 2012, 2013, 2014, 2015) are stored in a digital storage memory medium 240. The digital storage memory medium may include but is not limited to read-only memory (ROM) or flash memory (e.g., rewritable memory). The rewritable memory allows messages to be altered or updated.

The watch device 100 may further comprise a digital to analog converter 250 for converting the digitally stored pre-recorded audio message into an analog signal that the speaker can play. Digital to analog converters are well known to one of ordinary skill in the art. For example, such converters are commonly used in MP3 and CD players.

In some embodiments, if a digital screen showing digital images of mechanical hands moving on a clock face is used in lieu of a traditional analog watch face, the digital screen may be a liquid crystal display (LCD). LCDs are well known to one of ordinary skill in the art. In some embodiments, a thin film transistor (TFT) LCD may be used. The TFT LCD comprises a large number of pixels and circuitry for controlling each pixel. The data sent to each pixel is calculated so that when the appropriate pixels are active they display the appropriate image. Since the watch hands are moving the image information must be recalculated and sent to the display constantly so that the hands appear to be moving smoothly. In some embodiments, the minimum rate is 24 times per second. In some embodiments, the rate is more. Computer systems and televisions refresh screens at around 60 times per second (60 Hz). For such complex and repetitive calculations a microprocessor would be required.

If the hands are to appear as if they were physical objects, a large number of pixels are required. If a TFT LCD is used on the watch device 100, then it may also be programmed to display more than just the hands of an analog watch face. For example, it could also be programmed to display time in the style of a regular digital watch, or allow the user to select various styles of analog watch faces.

In some embodiments, the watch 100 further comprises a power button 150 for turning the watch on and off or voice on and off. The talking watch device 100 is powered via a power source. In some embodiments, the power source is a battery. In some embodiments, a battery compartment 180 is disposed in the base 110, for example near the bottom surface 115 of the base 110.

In some embodiments, the watch device 100 further comprises a means of checking the accuracy of the watch reading by the child. For example, the watch device 100 may comprise circuitry for checking an audio sound of the child reading the watch against a standard audio sound.

In some embodiments, an individual can adjust when the audio readout occurs (e.g., every hour, every half hour, every two hours, etc.). In some embodiments, the watch device 100 comprises circuitry for teaching a child the letters of the alphabet (e.g., can play a prerecorded audio message of the letters of the alphabet).

The talking watch device 100 may be constructed in a variety of sizes. In some embodiments, the base 110 is between about 1 to 2 inches in diameter. In some embodiments, the base 110 is between about 2 to 3 inches in diameter. In some embodiments, the base 110 is more than about 3 inches in diameter.

As used herein, the term "about" refers to plus or minus 10% of the referenced number. For example, an embodiment wherein the base 110 is about 3 inches in diameter includes a base 110 that is between 2.7 and 3.3 inches in diameter.

The following the disclosures of the following U.S. Patents are incorporated in their entirety by reference herein: U.S. Pat. No. 4,307,459; U.S. Pat. No. 3,338,045; U.S. Pat. No. 4,500,211; U.S. Pat. No. 4,421,416; U.S. Pat. No. 6,307,813.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. It is to be understood that the present invention is not limited to the embodiment describe above, but encompasses any and all embodiments within the scope of the following claims.

What is claimed is:

1. A talking watch device for helping a user learn time, said watch device comprising:

(a) a base (110) having a display (120) for displaying a clock face;

(b) a quartz oscillator assembly (230) disposed in the base, (c) a digital counter (220) operatively connected to the quartz oscillator assembly (230) and to a microprocessor (210), the digital counter keeps track of a time component and a day component and a month component and a year component;

(d) a memory medium (240) for storing a plurality of pre-recorded audio messages, the pre-recorded audio messages include a plurality of time component messages, a plurality of day component messages, a plurality of month component messages, and a plurality of year component messages;

(e) a speaker (160) component disposed in the base, the speaker is operatively connected to a digital to analog converter (250) for converting the pre-recorded audio message into an analog signal for the speaker;

(f) a power button (150) disclosed the base (110) for turning the speaker on and off; and (g) a dial (170) operatively connected to the microprocessor (210), the dial moves between a first position, a second position, a third position, and a fourth position;

wherein the dial is configured to select one of the pre-recorded audio messages output based on the dial settings, wherein each pre-recorded audio messages selected becomes more complex and contains more detailed information wherein the dial is configured as follows:

wherein the microprocessor is configured to receive a first input signal from the dial when the dial is in the first position whereupon the microprocessor generates a first recall command to the digital counter to obtain the time component whereupon the microprocessor generates a first output command to the speaker to play a time component message at a certain frequency, the time component message is based on the time component obtained from the digital counter;

wherein the microprocessor is configured to receive a second input signal from the dial when the dial is in the second position whereupon the microprocessor generates a second recall command to the digital counter to obtain the time component and the day component whereupon the microprocessor generates a second output command to the speaker to play a time component message and a day component message at a certain frequency, the time component message and the day component message is based on the time component and the day component obtained from the digital counter;

wherein the microprocessor is configured to receive a third input signal from the dial when the dial is in the third position whereupon the microprocessor generates a third recall command to the digital counter to obtain the time component and the day component and the month component whereupon the microprocessor generates a third output command to the speaker to play a time component message and a day component message and a month component message at a certain frequency, the time component message and the day component message and the month component message is based on the time component and the day component and the month component obtained from the digital counter;

wherein the microprocessor is configured to receive a fourth input signal from the dial when the dial is in the fourth position whereupon the microprocessor generates a fourth recall command to the digital counter to obtain the time component and the day component and the month component and the year component whereupon the microprocessor generates a third output command to the speaker to play a time component message and a day component message and a month component message and a year component message at a certain frequency, the time component message and the day component message and the month component message and the year component message is based on the time component and the day component and the month component and the year component obtained from the digital counter; and wherein the certain frequency is once every hour.

2. The talking watch device of claim 1 further comprising a strap (130) for attaching the base to a wrist of the user.

3. The talking watch device of claim 1, wherein the clock face is a digital version of a mechanical clock face.

4. The talking watch device of claim 3, wherein the digital version of the mechanical clock face is a liquid crystal display (LCD).

5. The talking watch device of claim 3, wherein the digital version of the mechanical clock face is a thin film transistor (TFT) LCD.

6. The talking watch device of claim 1, wherein the clock face is a mechanical clock face.

7. The talking watch device of claim 1, wherein the clock face is operatively connected to the digital counter or to the microprocessor.

8. The talking watch device of claim 1, wherein the digital counter (220) is operatively connected to a power source.

9. The talking watch device of claim 8, wherein the power source is a battery.

10. The talking watch device of claim 1, wherein the microprocessor (210) is a digital logic control circuit.

11. The talking watch device of claim 1, wherein the time component is an hour and minute.

12. The talking watch device of claim 1, wherein the time component is an hour.

13. The talking watch device of claim 1, wherein the certain frequency is once or every hour.

14. The talking watch device of claim 1, wherein the memory medium (240) is read-only memory or flash memory.

15. The talking watch device of claim 1, wherein the speaker (160) is disposed in a side edge of the base.

16. The talking watch device of claim 1, wherein the user can adjust the certain frequency.

17. The talking watch device of claim 1 further comprising a setting means (140) for setting the time component and the day component and the month component and the year component.

18. A method of teaching time, the method comprising:

(a) obtaining a watch device (100) comprising:

(i) a base (110) having a display (120) for displaying a clock face;

(ii) a quartz oscillator assembly (230) disposed in the base, (iii) a digital counter (220) operatively connected to the quartz oscillator assembly (230) and to a microprocessor (210), the digital counter keeps track of a time component and a day component and a month component and a year component;

(iv) a memory medium (240) for storing a plurality of pre-recorded audio messages, the pre-recorded audio messages include a plurality of time component messages, a plurality of day component messages, a plurality of month component messages, and a plurality of year component messages;

(v) a speaker (160) component disposed in the base, the speaker is operatively connected to a digital to analog converter for converting the pre-recorded audio message into an analog signal for the speaker; and (vi) a dial (170) operatively connected to the microprocessor, the dial move between a first position, a second position, a third position, and a fourth position;

wherein the dial is configured to select one of the pre-recorded audio messages output based on the dial settings, wherein each pre-recorded audio messages selected becomes more complex and contains more detailed information, wherein the dial is configure as follows:

wherein the microprocessor is configured to receive a first input signal from the dial when the dial is in the first position whereupon the microprocessor generates a first recall command to the digital counter to obtain the time component whereupon the microprocessor generates a first output command to the speaker to play a time component message at a certain frequency, the time component message is based on the time component obtained from the digital counter; wherein the microprocessor is configured to receive a second input signal from the dial when the dial is in the second position whereupon the microprocessor generates a second recall command to the digital counter to obtain the time component and the day component whereupon the microprocessor generates a second output command to the speaker to play a time component message and a day component message at a certain frequency, the time component message and the day component message is based on the time component and the day component obtained from the digital counter; wherein the microprocessor is configured to receive a third input signal from the dial when the dial is in the third position whereupon the microprocessor generates a third recall command to the digital counter to obtain the time component and the day component and the month component whereupon the microprocessor generates a third output command to the speaker to play a time component message and a day component message and a month component message at a certain frequency; the time component message and the day component message and the month component message is based on the time component and the day component and the month component obtained from the digital counter; and wherein the microprocessor is configured to receive a fourth input signal from the dial when the dial is in the fourth position whereupon the microprocessor generates a fourth recall command to the digital counter to obtain the time component and the day component and the month component and the year component whereupon the microprocessor generates a fourth output command to the speaker to play a time component message and a day component message and a month component message and a year component message at a certain frequency, the time component message and the day component message and the month component message and the year component message is based on the time component and the day component and the month component and the year component obtained from the digital counter; wherein the certain frequency is once every hour;

(vii) a power button (150) disposed in the base (110) for turning the speaker on and off; and (b) setting the dial in the first position, the second position, the third position, or the fourth position.

19. A talking watch device for helping a user learn time, said watch device consisting of:

(a) a base (110) having a display (120) for displaying a clock face;

(b) a quartz oscillator assembly (230) disposed in the base, (c) a digital counter (220) operatively connected to the quartz oscillator assembly (230) and to a microprocessor (210), the digital counter keeps track of a time component and a day component and a month component and a year component;

(d) a memory medium (240) for storing a plurality of pre-recorded audio messages, the pre-recorded audio messages include a plurality of time component messages, a plurality of day component messages, a plurality of month component messages, and a plurality of year component messages;

(e) a speaker (160) component disposed in the base, the speaker is operatively connected to a digital to analog converter (250) for converting the pre-recorded audio message into an analog signal for the speaker;

(f) a power button (150) disposed in the base (110) for turning the speaker on and off; and (g) a dial (170) operatively connected to the microprocessor (210), the dial moves between a first position, a second position, a third position, and a fourth position;

wherein the dial is configured to select one of the pre-recorded audio messages output based on the dial settings, wherein each pre-recorded audio messages selected becomes more complex and contains more detailed information, wherein the dial is configured as follows:

wherein the microprocessor is configured to receive a first input signal from the dial when the dial is in the first position whereupon the microprocessor generates a first recall command to the digital counter to obtain the time component whereupon the microprocessor generates a first output command to the speaker to play a time component message at a certain frequency, the time component message is based on the time component obtained from the digital counter;

wherein the microprocessor is configured to receive a second input signal from the dial when the dial is in the second position whereupon the microprocessor generates a second recall command to the digital counter to obtain the time component and the day component whereupon the microprocessor generates a second output command to the speaker to play a time component message and a day component message at a certain frequency, the time component message and the day component message is based on the time component and the day component obtained from the digital counter;

wherein the microprocessor is configured to receive a third input signal from the dial when the dial is in the third position whereupon the microprocessor generates a third recall command to the digital counter to obtain the time component and the day component and the month component whereupon the microprocessor generates a third output command to the speaker to play a time component message and a day component message and a month component message at a certain frequency, the time component message and the day component message and the month component message is based on the time component and the day component and the month component obtained from the digital counter;

wherein the microprocessor is configured to receive a fourth input signal from the dial when the dial is in the fourth position whereupon the microprocessor generates a fourth recall command to the digital counter to obtain the time component and the day component and the month component and the year component whereupon the microprocessor generates a third output command to the speaker to play a time component message and a day component message and a month component message and a year component message at a certain frequency, the time component message and the day component message and the month component message and the year component message is based on the time component and the day component and the month component and the year component obtained from the digital counter; and wherein the certain frequency is once every hour, wherein the device further consists of a battery that is operatively connected to the quartz oscillator assembly, the digital counter, the memory medium, the speaker, the dial and the power button.

* * * * *